US005328208A

United States Patent [19]

Garrison

[11] Patent Number: 5,328,208

[45] Date of Patent: Jul. 12, 1994

[54] PHARMACY FORM AND METHOD

[75] Inventor: Ronald R. Garrison, Batavia, Ill.

[73] Assignee: Wallace Computer Services, Inc., Hillside, Ill.

[21] Appl. No.: 93,271

[22] Filed: Jul. 19, 1993

[51] Int. Cl.[5] ..... B42D 15/00

[52] U.S. Cl. ..... 283/105; 283/101; 283/81

[58] Field of Search ..... 283/67, 70, 74, 81, 283/101, 105, 900; 40/310, 299

[56] References Cited

U.S. PATENT DOCUMENTS 5,048,870 9/1991 Mangini et al. ..... 283/81
5,147,699 9/1992 Browning et al. ..... 283/81 X
5,178,419 1/1993 Bolnick et al. ..... 283/81
5,182,152 1/1993 Ericson ..... 283/81 X

*Primary Examiner*—Mark Rosenbaum
*Assistant Examiner*—William Fridie, Jr.
*Attorney, Agent, or Firm*—Tilton, Fallon, Lungmus & Chestnut

[57] ABSTRACT

A pharmacy form including a unitary, elongated sheet having a transverse diecut intermediate the ends thereof defining a label part and an information part in co-planar relation, printed label and information indicia on one face of the sheet and pressure sensitive adhesive on the other face of the sheet extending over said label part and a specified distance onto the information part.

4 Claims, 1 Drawing Sheet

PHARMACY FORM AND METHOD

BACKGROUND AND SUMMARY OF INVENTION

This invention relates to a pharmacy form and method and, more particularly, to a form useful in connection with the dispensing of prescription drugs.

It is increasingly necessary for pharmacists, first, to maintain accurate records of the prescription drugs they dispense and, second, to clearly notify or advise the customer of the usage information, dosage, warnings, etc. This has resulted in the proliferation of forms used by the pharmacists and there is ever-present the chance of confusing information in a multiple form system. This could result in "matching" the drug with the wrong prescription.

The instant invention provides a business form that is useful in any pharmacy when the pharmacist is filling a prescription. The form can include a label for the prescription package, a warning label or labels, signature label and information label. Still further, the form could optionally include a receipt for the insurance company, a receipt for the customer/patient's record and a location for printing any information that is required by law that the pharmacist must give on the medication. The instant invention makes possible the presentation of all of the above items on a single form and further permits variable information to be printed at the same time on one printer.

Thus, the invention provides a complete system of forms and labels needed by the pharmacist to fill a prescription. Because the inventive form has all parts attached and all parts being printed at the same time the amount of time to fill a prescription is decreased and, equally importantly, the chance of confusing or mixing information from a multiple form system is eliminated—because all of the information is one sheet.

The inventive form includes a unitary elongated sheet having a transverse diecut intermediate the ends thereof defining a label part and an information part. There is provided printed label and information indicia on one face of the sheet and pressure sensitive adhesive on the other face of the sheet extending over the label part and partway into the information part. Still further, a release liner covering the adhesive is provided on the other face of the sheet.

BRIEF DESCRIPTION OF DRAWING

The invention is described in conjunction with an illustrative embodiment in the accompanying drawing in which.

DETAILED DESCRIPTION

The numeral 10 designates generally a string of connected forms which, depending upon the type of computer printer employed by the pharmacy may have control punch margins (not shown). An illustration of a label-equipped form having control punch margins is co-owned Patent 4,664,416.

Figure 1:
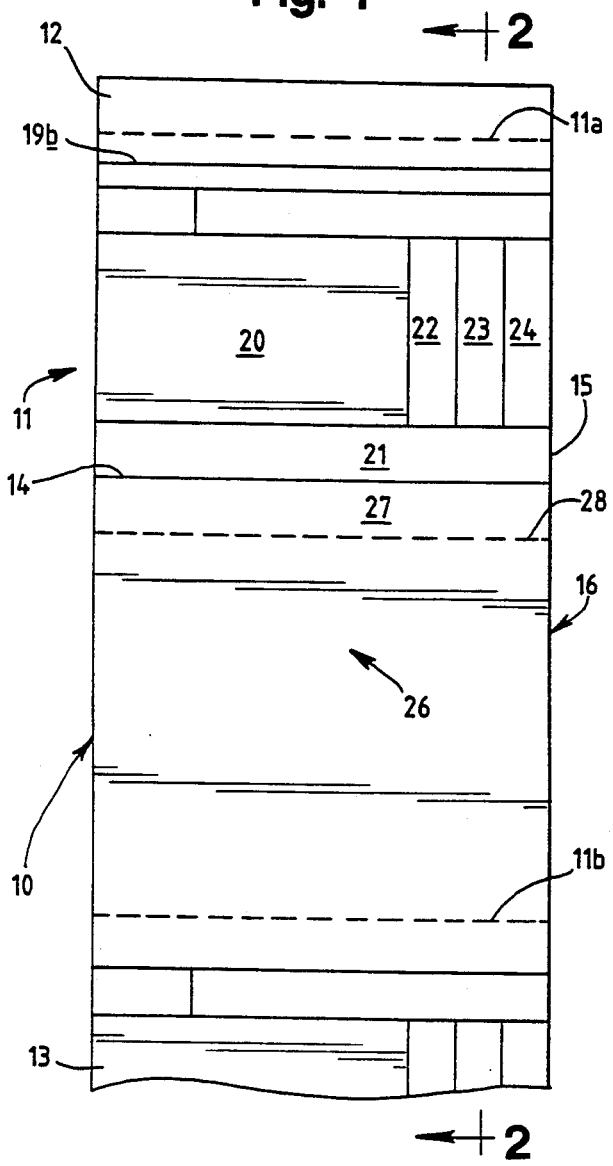
FIG. 1 is a plan view of the inventive form shown as part of a string or connected series of forms.

The connected string 10 includes form lengths 11, 12 and 13 which are separated or defined in part by transverse lines of perforation as at 11*a* and 11*b*—still referring to FIG. 1.

The numeral 14 designates a transverse diecut, i.e., a complete severing of the single sheet 10 defining the sequence of forms. Spaced on opposite sides of the transverse diecut line 14 is a label part generally designated 15 and an information part generally designated 16. As will be brought out hereinafter, a portion of the label part 15 is pasted to the drug container while the information part 16 can be temporarily pasted to the bag for the container.

To facilitate the above-mentioned adhering steps, a layer of adhesive 17 is provided along with a release liner 18 which carries a release agent 19 such as a silicone. For example, the liner 18 of conventional stock is first equipped with a silicone coating 19 and thereafter with the adhesive coating 17.

A small area as at 19*a* of no silicone, may be provided on at least one edge of the liner 18 or up to 4 edges. This helps to "freeze" the liner 18 to the face of the form 11 by means of the adhesive coating 17. This prevents the liner 18 from coming off (predispensing) in the printer and exposing any adhesive 17 on the back of the form 11. Additional details of the application and function of the freezing of the liner can be found in the co-pending applications of Donald J. Hoffmann Ser. No. 882,433 filed May 13, 1992, now Pat. No. and Ser. No. 886,739 filed May 21, 1992, now Pat. No. 5,254,381. To facilitate the removal of the various labels, I provide a diecut as at 19*b* which permits the removal of the labels provided in form length 11 as at 20–24.

This double coated sheet 18 is then applied to one face of the form length 11—after which the form length can be diecut at 14 with the release liner patch 18 holding the two parts 15 and 16 together.

The face of the form 11 opposite to that equipped with the release liner 18 is equipped with printed indicia and further diecuts so as to define a removable label 20, a signature sticker or portion 21 and warning stickers 22, 23 and 24—each of the above being defined by diecuts through the sheet constituting the form 11 but not extending into the release liner 18 and its double coating.

Operation

Figure 3:
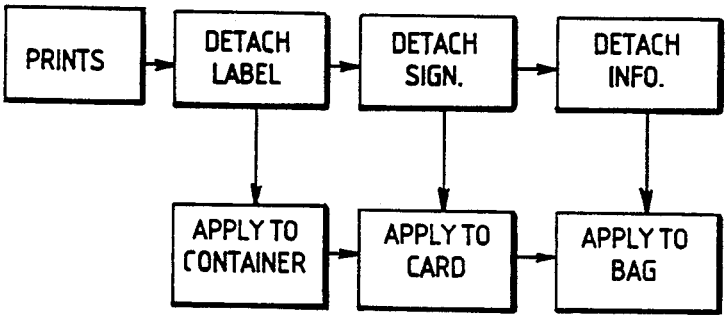
FIG. 3 is a schematic form showing the steps performed in the practice of the method of the invention.

Reference is now made to FIG. 3. The first box depicted there contains the word PRINT and this refers to the fact that the pharmacy is equipped with a computer printer which is capable of applying all of the information necessary under law to advise the patient/customer of what he/she is getting under the prescription. For example, the label 20 will carry the information usually provided by the pharmacist in filling a prescription, i.e., name of patient, name of doctor, dosage, etc. The warning stickers 22, 23 and 24 may warn against using alcohol, not to drive, not take on an empty stomach, etc.

It will be appreciated that the computer associated with the printer at the pharmacy has a memory which stores certain fixed information—such as the warning legends referred to above relative to the stickers 22–24. The above-mentioned computer also has the capability of introducing variable information such as that required at 20. Other fixed information may be provided as at 25 which deals with the "proper use" of the medication. For example, if the medication were insulin for the treatment of diabetes, instructions are given about wiping the top of the bottle with an alcohol swab, removing the needle cover from the syringe, etc. This information is all carried in the memory of the computer and is applied when called upon for a specific prescription.

Figure 4:
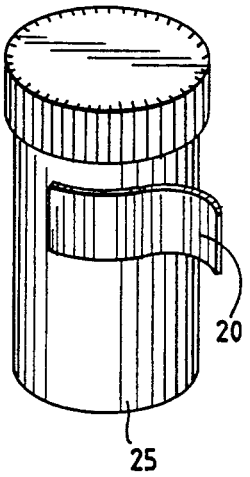
FIG. 4 is a perspective view of a medicine container in the process of being used according to the invention.
Figure 5:
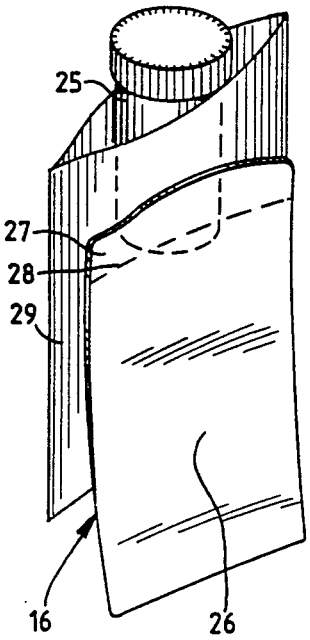
FIG. 5 is a another perspective view depicting the medicine container in a subsequent stage of manipulation according to the invention.

After the PRINT step has been performed the form length 11 is now ready for usage. The form length 11 is separated from the following forms as by separation along the transverse line of perforation 11*b*. Normally, the first step is to detach the label 20 from the form and apply it to the medicine container. Also at this time, any warning stickers as at 22–24 may be applied as well. As seen in FIG. 4, the label 20 is in the process of being applied to a medicine container 25.

The next step could be, if such is indicated by law or practice, to detach the signing strip or sticker 21 and apply it to the permanent record kept by the pharmacist. This card with the signature sticker applied thereto is advantageously proffered to the patient at the time of purchase so as to indicate that the patient has been given the set of instructions which are included in the instruction section 16 and reflected by the fixed information 26. The information part 16 thus includes the part with the fixed information 26, i.e., the specific instructions, and also an upper part 27 which is separated from the lower part 26 by a line of perforation 28.

The information part 16 is detached from the liner 18 and applied to a bag 29 which contains the prescribed medicine. Thus, the operation in aggregating the medicine and the instructions is performed substantially simultaneously and this substantially avoids any possibility of mix-up of drug and instructions for use.

Figure 2:
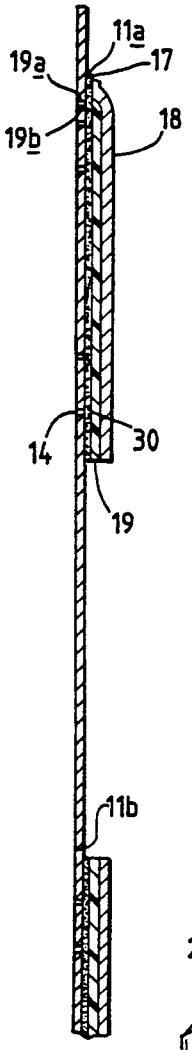
FIG. 2 is a sectional view such as would be seen along the sight line 2—2 applied to FIG. 1.

This affixing of the information part 16 is made possible by the provision of a portion of pressure sensitive adhesive at 30 (see FIG. 2) which is under the upper portion 27 of the information part 16. In other words, the adhesive extends over substantially all of the label part 15 and only partway into the information part 16.

After the container 25 has been introduced into the bag 29, the information portion 26 of the information part generally designated 16 can be detached along the line of perforation 28 from the upper portion 27 and this information lower part is also put into the bag. Alternatively, it may be handed to the customer but in any event, up to the time of purchase, the instruction portion 16 by virtue of being affixed to the bag 29 serves to make sure that there is no mix-up between the medicine and the instructions.

As indicated above, there may be provided an edge area 19*a* of the release liner which is free of silicone or other release coating and which may be adhered to a minor portion of the form length 11. This minor portion can be of the order of 1/16" or so. Thus, the release liner 18 is frozen to the form length 11 but only in a minor portion thereof.

While in the foregoing specification a detailed description of an embodiment of the invention has been set down for the purpose of illustration, many variations in the details hereingiven may be made by those skilled in the art without departing from the spirit and scope of the invention.

I claim:

1. A pharmacy form comprising a unitary, elongated sheet having a transverse diecut intermediate the ends thereof defining a label part and an information part in co-planar relation, printed label and information indicia on one face of said sheet and pressure sensitive adhesive on the other face of said sheet extending over said label part and a specified distance onto said information part, and a release liner covering said adhesive whereby said label part and information part are maintained in co-planar relation, said label part having a portion to be applied to a drug container and said information part has a portion corresponding to said spaced distance to be pasted to a bag for said container, said information part being equipped with a line of transverse weakness spaced from said portion to be pasted for detachment from said portion.

2. The form of claim 1 in which said label part is equipped with a diecut defining a warning sticker.

3. The form of claim 1 in which said label part is equipped with a diecut defining a signature sticker.

4. The form of claim 1 in which said release liner has a release coating on the fact thereof adjacent said adhesive, said release coating terminating short of at least one edge of said release liner whereby said release liner is frozen to said sheet.

* * * * *